US007749090B2

(12) United States Patent
Caron et al.

(10) Patent No.: US 7,749,090 B2
(45) Date of Patent: Jul. 6, 2010

(54) BILLIARD TABLE AND BILLIARD BALL STORAGE COMPARTMENT WITH MATING CONNECTORS

(75) Inventors: Theodore Caron, Kenosha, WI (US); Michael Reedy, Chicago, IL (US)

(73) Assignee: Brunswick Bowling & Billiards Corporation, Lake Forest, IL (US)

( * ) Notice: Subject to any disclaimer, the term of this patent is extended or adjusted under 35 U.S.C. 154(b) by 162 days.

(21) Appl. No.: 12/006,809

(22) Filed: Jan. 3, 2008

(65) Prior Publication Data

US 2009/0176589 A1 Jul. 9, 2009

(51) Int. Cl.
*A63D 13/00* (2006.01)
*A63D 15/00* (2006.01)
*A63D 15/06* (2006.01)

(52) U.S. Cl. ..... 473/33; 473/31; 473/1; 473/4

(58) Field of Classification Search ..... 473/31, 473/32, 33, 1, 6, 14, 18; D21/782–784
See application file for complete search history.

(56) References Cited

U.S. PATENT DOCUMENTS 1,540,316 A * 6/1925 Clement ..... 473/11
2,008,613 A * 7/1935 Hernes ..... 108/90
2,572,333 A * 10/1951 Greitzer ..... 108/90
D192,086 S * 1/1962 Reineman ..... D21/784
3,319,958 A * 5/1967 Bender ..... 473/15
3,941,378 A * 3/1976 Bagley ..... 473/10
4,345,758 A * 8/1982 Kempf ..... 473/475
6,053,818 A 4/2000 McCormick
6,095,463 A 8/2000 McCormick
6,149,530 A * 11/2000 Shih ..... 473/22
D594,522 S * 6/2009 Callif et al. ..... D21/783
D598,515 S * 8/2009 Blair et al. ..... D21/784
D599,426 S * 9/2009 Blair et al. ..... D21/784
2004/0224780 A1* 11/2004 Nagle ..... 473/2
2005/0221902 A1* 10/2005 Chen ..... 473/4
2007/0155519 A1* 7/2007 Panzica ..... 473/1
2009/0082119 A1* 3/2009 McCormick ..... 473/33

* cited by examiner

*Primary Examiner*—Mitra Aryanpour
(74) *Attorney, Agent, or Firm*—Brinks Hofer Gilson & Lione

(57) ABSTRACT

A billiard table and billiard ball storage compartment with mating connectors are disclosed. In one embodiment, a billiard table is provided comprising a frame comprising a first connector, a playing surface supported by the frame, and a billiard ball storage compartment comprising a second connector, wherein the second connector is configured to mate with the first connector when the billiard ball storage compartment is moved into a first position with respect to the frame. In exemplary embodiments, the billiard ball storage compartment comprises a ball storage box and/or a ball receiver box.

9 Claims, 8 Drawing Sheets

BILLIARD TABLE AND BILLIARD BALL STORAGE COMPARTMENT WITH MATING CONNECTORS

BACKGROUND

Billiard tables may be provided with a billiard ball storage compartment. In some billiard tables, the billiard ball storage compartment takes the form of a billiard ball storage box behind a bezel-framed opening in the apron of the table. In other billiard tables, the billiard ball storage compartment takes the form of a billiard ball receiver box, which receives billiard balls shot into one of the pockets of the table via a ball transport track under the table. In yet other billiard tables, the billiard ball storage compartment contains both a billiard ball storage box and a billiard ball receiver box. With any of these billiard tables, the billiard ball storage compartment is typically secured to the frame of the billiard table with several (e.g., 6-8) screws. Unfortunately, the screws are often located in locations that are not easily accessible to the user. In addition to the difficulty in accessing the screws, a user may need assistance in supporting the billiard ball storage compartment while installing the screws. Accordingly, installing the billiard ball storage compartment can be a difficult task. Since a user sometimes needs to remove the billiard ball storage compartment (such as when replacing the felt surface that covers the playing surface of the table), similar difficulties can be encountered when removing and reinstalling the screws in the removal-and-reinstallation process.

SUMMARY

The present invention is defined by the claims, and nothing in this section should be taken as a limitation on those claims.

By way of introduction, the embodiments described below provide a billiard table and billiard ball storage compartment with mating connectors. In one embodiment, a billiard table is provided comprising a frame comprising a first connector, a playing surface supported by the frame, and a billiard ball storage compartment comprising a second connector, wherein the second connector is configured to mate with the first connector when the billiard ball storage compartment is moved into a first position with respect to the frame. In exemplary embodiments, the billiard ball storage compartment comprises a ball storage box and/or a ball receiver box. Other embodiments are disclosed, and each of the embodiments can be used alone or together in combination.

The embodiments will now be described with reference to the attached drawings.

DETAILED DESCRIPTION OF THE PRESENTLY PREFERRED EMBODIMENTS

Figure 1:
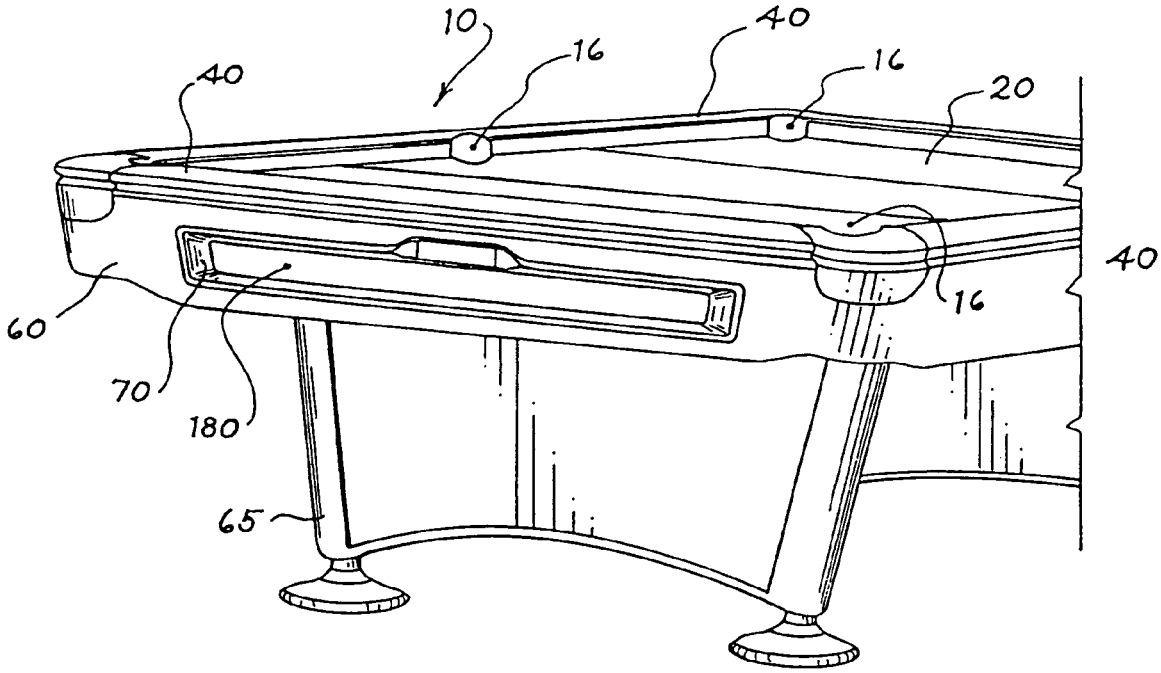
FIG. 1 is a perspective view of a billiard table of an embodiment.

Turning now to the drawings, FIG. 1 shows a billiard (or pool) table 10 of an embodiment. The billiard table 10 comprises a playing surface 20, a plurality of rails 40 adjacent the playing surface 20, and a plurality of aprons (apron 60 is shown in this view). As used herein, the term "adjacent to" means directly adjacent to or indirectly adjacent to through one or more intervening components shown or not shown herein. Similarly, the phrase "coupled with" can mean directly coupled with or indirectly coupled with through one or more components named or unnamed herein. In this embodiment, the billiard table 10 also includes a plurality of pockets 16 that are configured to receive billiard balls during the course of a billiard game. However, some alternate billiard tables may not include pockets.

The playing surface 20 is preferably a solid, flat, horizontally-disposed elongated member that provides a suitable surface for billiard balls to roll thereupon during a billiard game. The playing surface 20 can take any suitable form including, but not limited to, slate, plastic, or wood. A layer of fabric, such as felt, is disposed and stretched over the top and side surfaces of the playing surface 20 to provide a smooth and aesthetically-pleasing visible portion of the playing surface 20. The plurality of rails 40 provide side surfaces of the billiard table 10. In this way, the plurality of rails 40 define a substantially-enclosed geometry that serves as the playing area of the billiard table 10. In some embodiments, the plurality of rails 40 include an inner edge that may be formed from a slightly compressible material, or a cushion, that is oriented to be contacted by the billiard balls as they reach an edge of the playing surface, which allows the billiard balls to carom off the rails 40. It should be noted that, although shown as single pieces in the drawings, one or more of the plurality of rails 40 can be made up of a plurality of components connected together (e.g., in an end-to-end fashion). The plurality of rails 40 can be mechanically connected directly to the playing surface 20 or can be indirectly connected to the playing surface 20 with an intermediate member, such as an apron 60. In general, the apron 60 is a component, usually wood, between the plurality of rails 40 and the legs 65 that covers the edges of the playing surface 20, felt, and table frame to provide a finished look.

The playing surface 20 is supported by a "frame" (shown as 18 in several of the drawings). As used herein, the frame refers to the mechanical structure (or "skeleton") upon which the playing surface 20 is attached. A "frame" can also refer to the mechanical structure with one or more of the rails 40, aprons 60, or other components attached. Accordingly, when it is stated that the frame comprises a connector, that connector can be disposed on the basic mechanical skeleton of the billiard table 10 or on one of the components attached to the basic mechanical skeleton (e.g., the apron 60).

Turning again to FIG. 1, the billiard table 10 also comprises a billiard ball storage compartment 180 configured to receive and retain billiard balls. In this embodiment, the billiard ball storage compartment 180 takes the form of a billiard ball storage box, which, in this embodiment, is positioned adjacent to a bezel-framed opening 70 in the apron 60 of the table 10. As will be discussed below, in other embodiments, the billiard ball storage compartment can additionally or alternatively take the form of a billiard ball receiver box.

In this embodiment, the frame 18 and the billiard ball storage compartment 180 comprise mating connectors that are configured to mate together when the billiard ball storage compartment 180 is moved into a certain ("first") position with respect to the frame. Because the frame 18 and the billiard ball storage compartment 180 comprise mating connectors, the process of installing, removing, and re-installing the billiard ball storage compartment 180 is much easier than with tables in which the billiard ball storage compartment is secured to the table with several (e.g., 6-8) screws located in locations that are not easily accessible to the user. As another advantage, this embodiment allows the billiard ball storage compartment 180 to be installed and removed from the table 10 without the use of any external tools (e.g., a screwdriver). If desired, once the mating connectors are engaged with one another and the billiard ball storage compartment 180 is held in place, the user can install screws for additional support. However, unlike prior tables, an additional user is not required to hold the billiard ball storage compartment 180 in place when the first user installs the screws because the mating connectors hold the billiard ball storage compartment 180 in place once engaged.

Figure 2:
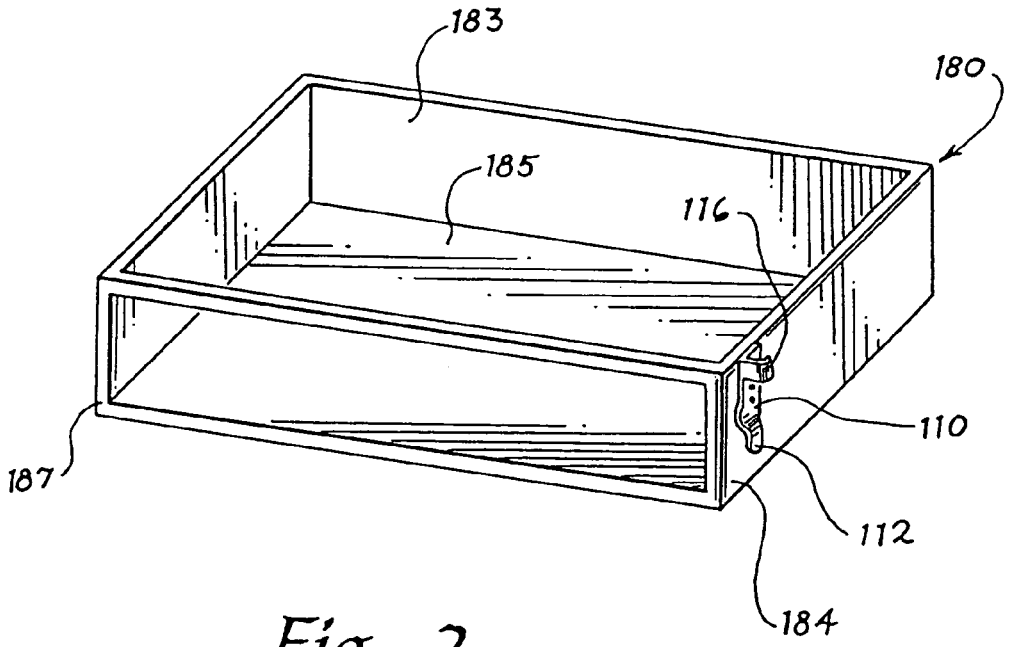
FIG. 2 is a perspective view of a billiard ball storage compartment of an embodiment.

Turning again to the drawings, FIG. 2 shows the billiard ball storage compartment 180 in more detail. As shown in FIG. 2, the billiard ball storage compartment 180 comprises a rear surface 183, two side surfaces (one of which being side surface 184), a bottom surface 185, and a front surface 187 that defines an internal storage volume. The billiard ball storage compartment 180 also comprises two connectors. One of the connectors 110 is shown attached to the side surface 184. The other connector is not shown in this view but is located in a corresponding position on the other side surface. As shown in more detail in FIG. 3, in this embodiment, the connector 110 is attached to the billiard ball storage compartment 180 via fasteners (here, screws 101) through holes 102 in the central portion 114 of the connector 100. Also, the connector 110 comprises a male portion formed as a tooth 112 and a female portion formed as a receptacle 116. The tooth 112 extends from the central portion 114 at an oblique angle, such that the tooth 112 is substantially parallel to the central portion 114 but offset a distance Z from the central portion 114. The distance Z may be slightly greater than the thickness of the tooth 112.

Figure 3:
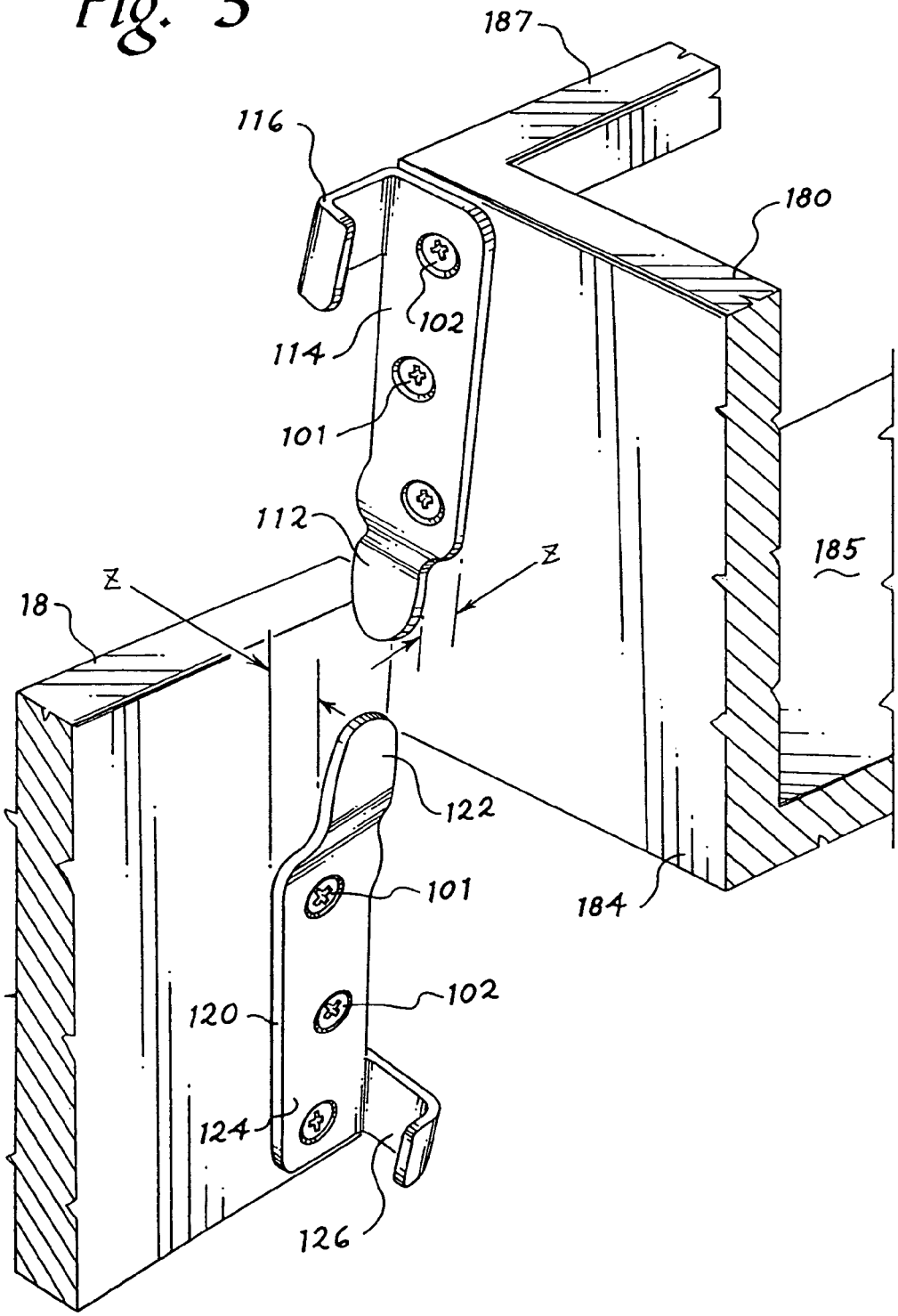
FIG. 3 is an illustration of a billiard ball storage compartment and billiard table frame of an embodiment before connectors on those components are mated together.

As also shown in FIG. 3, a second mating connector 120 is attached to the frame 18 of the table 10 via fasteners (here, screws 101) through holes 102 in the central portion 124 of the second connector 120. As with the first connector 110, the second connector 120 comprises a male portion formed as a tooth 122 (here, offset from the central portion 124 by the same distance Z as the first connector 110) and a female portion formed as a receptacle 126. In fact, in this embodiment, the first and second connectors 110, 120 are identical but oriented 180 degrees opposite from one another. (It should be noted that while in this particular implementation the mating connectors 110, 120 are identical but positioned differently from one another, in other embodiments, the mating connectors are shaped differently from one another.) In this embodiment, the second side surface of the billiard ball storage compartment 180 and the corresponding location on the frame 18 contain additional mating connectors, although, in other embodiments, different numbers of mating connectors are used.

Figure 4:
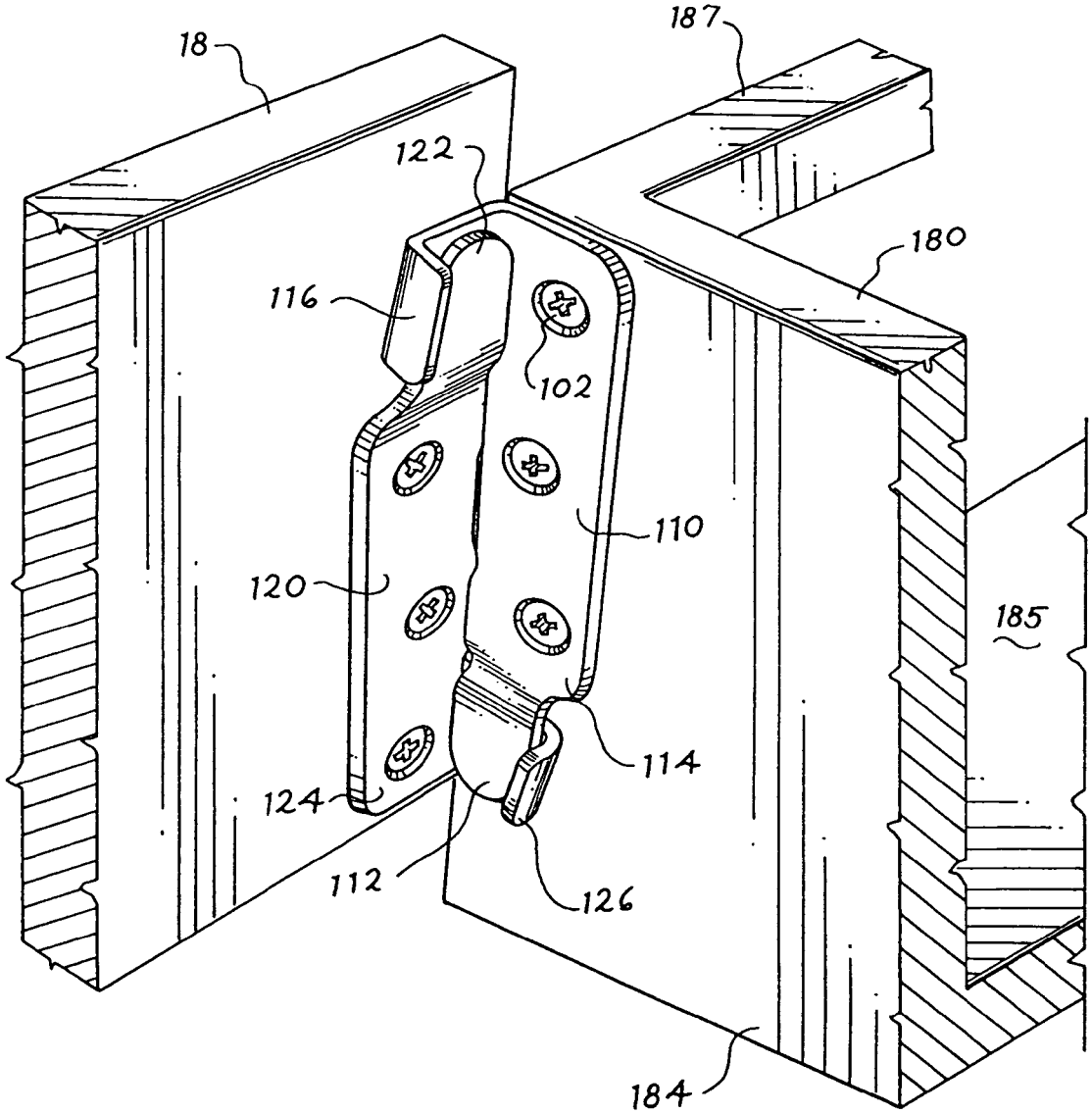
FIG. 4 is an illustration of a billiard ball storage compartment and billiard table frame of an embodiment after connectors on those components are mated together.

To mate the first and second connectors 110, 120, a user positions the billiard ball storage compartment 180 in such a way as to "hook" the receptacle 116 of the first connector 110 onto the tooth 122 of the second connector 120, while, at the same time, "hooking" receptacle 126 of the second connector 120 onto the tooth 112 of the first connector 110 (i.e., moving the billiard ball storage compartment 180 in a "first position" with respect to the frame 18). Similar mating would occur at the same time with the additional mating connectors on the side surface of the billiard ball storage compartment 180 and the corresponding location on the frame 18. FIG. 4 is an illustration of the billiard ball storage compartment 180 and frame 18 when the first and second connectors 110, 120 are mated with each other.

Figure 5:
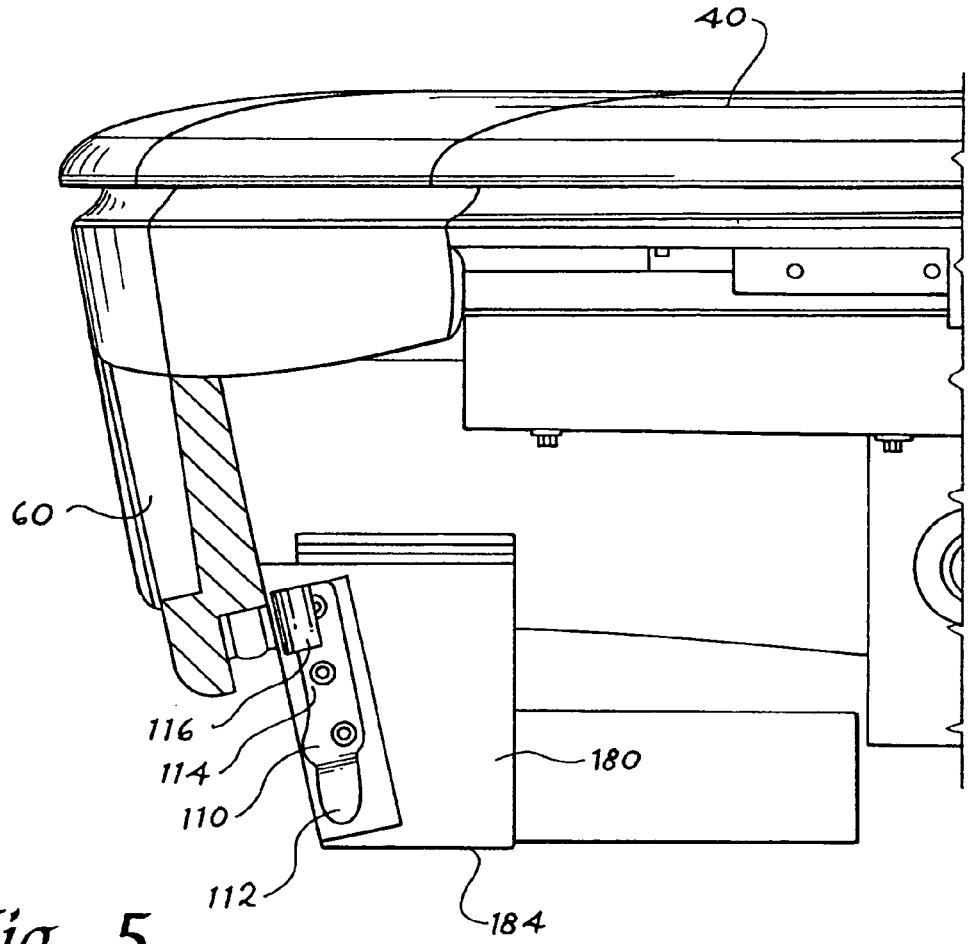
FIG. 5 is an illustration of a billiard table of an embodiment before a billiard ball storage compartment is moved into a first position.

The "first position" that the billiard ball storage compartment 180 is moved to in order to mate the connectors 110, 120 can depend on the configuration of the billiard table 10, frame 18, and billiard ball storage compartment 180. For example, in the embodiment shown in FIG. 5, the billiard ball storage compartment 180 is initially held in the position shown and then lifted upward until the receptacle 116 of the first connector 110 extends above the tooth 122 of the second connector 120. Next, the storage compartment 180 is translated forward (i.e., toward the apron 60) until the receptacle 116 of the first connector 110 is disposed between the tooth 122 of the second connector 120 and the frame 18. At this orientation, the receptacle 126 of the second connector 120 is additionally aligned below the tooth 112 of the first connector 110. Finally, the billiard ball storage compartment 180 is lowered until the receptacle 116 of the first connector 110 engages the tooth 122 of the second connector 220 and the tooth 112 of the first connector 110 engages the receptacle 126 of the second connector 120. To remove the billiard ball storage compartment 180, a user would reverse the above process (i.e., lifting the billiard ball storage compartment 180 upward with respect to the frame 18, moving the billiard ball storage compartment 180 slightly inwardly, and then lowering the billiard ball storage compartment 180 below the frame 18). As mentioned above, different configurations (and, thus, different "first positions") can be used. Also, while the shown connectors 110, 120 and un-shown additional connectors on the other side of the billiard ball storage compartment 180 and frame 18 were described above as being engaged substantially simultaneously, in other embodiments, the various connectors can be engaged sequentially.

Figure 6:
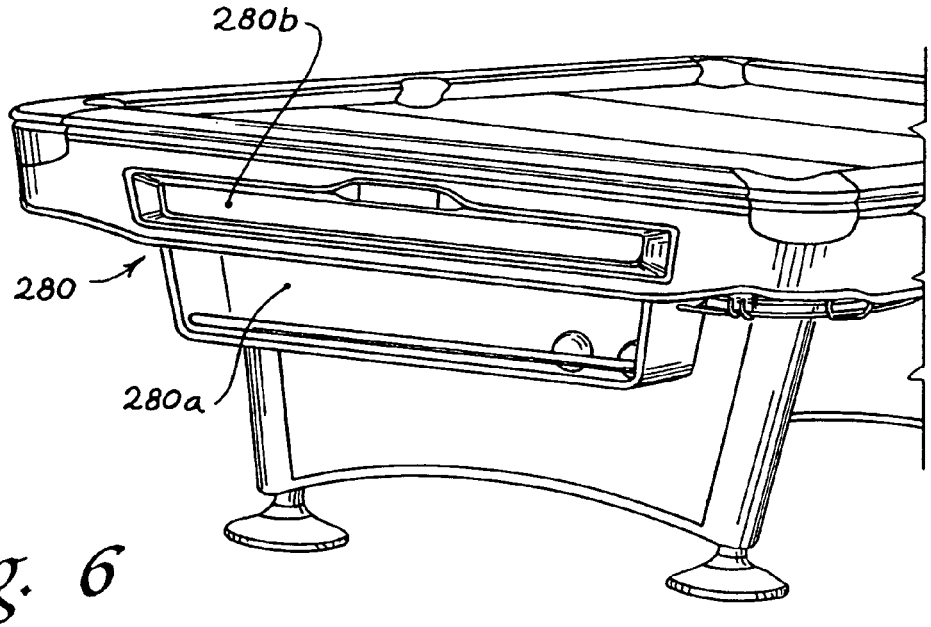
FIG. 6 is an illustration of a billiard table of another embodiment.

In the above embodiments, the billiard ball storage compartment 180 took the form of a billiard ball storage box. In another embodiment (shown in FIG. 6), the billiard ball storage compartment 280 takes the form of a billiard ball receiver box 280*a*. In this embodiment, the billiard ball storage compartment 280 additionally contains a billiard ball storage box 280*b*. In other embodiments, the billiard ball storage compartment 280 only contains a billiard ball receiver box 280*a* and not a billiard ball storage box 280*b*. In such embodiments, if the billiard table contains a billiard ball storage box, it would be provided by a different component than the billiard ball storage compartment (e.g., built into the table or attached to the table as a separate component with or without mating connectors).

Figure 7:
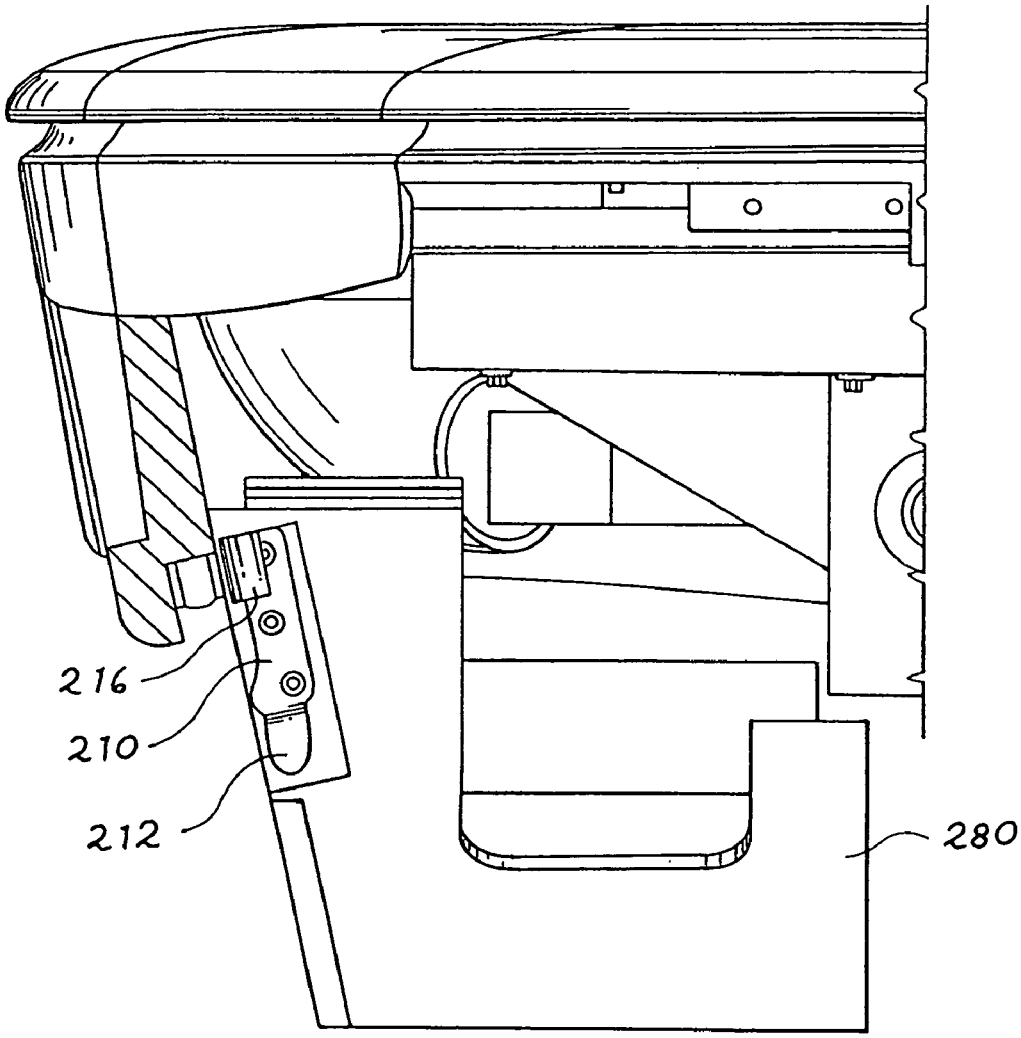
FIG. 7 is an illustration of a billiard table of an embodiment before a billiard ball storage compartment is moved into a first position.

As shown in FIG. 7, as with the embodiment described above, this billiard ball storage compartment 280 comprises a connector 210 comprising a male portion formed as a tooth 212 and a female portion formed as a receptacle 216. This connector 210 mates with a second connector attached to the frame of the table when the billiard ball storage compartment 280 is moved to a certain position with respect to the frame. As with the above embodiment, the second connector is identically shaped but oppositely oriented with respect to the first connector 210. In this way, positioning the billiard ball storage compartment 280 in the first position "hooks" the receptacle 216 of the first connector 210 onto the tooth of the mating second connector, while, at the same time, "hooking" the receptacle of the second connector onto the tooth 212 of the first connector 210. As mentioned above, in different embodiment, different types (e.g., non-identical) of connectors can be used. Accordingly, the shape and orientation of any of the connectors described herein should not be read into the claims unless explicitly recited therein.

Figure 8:
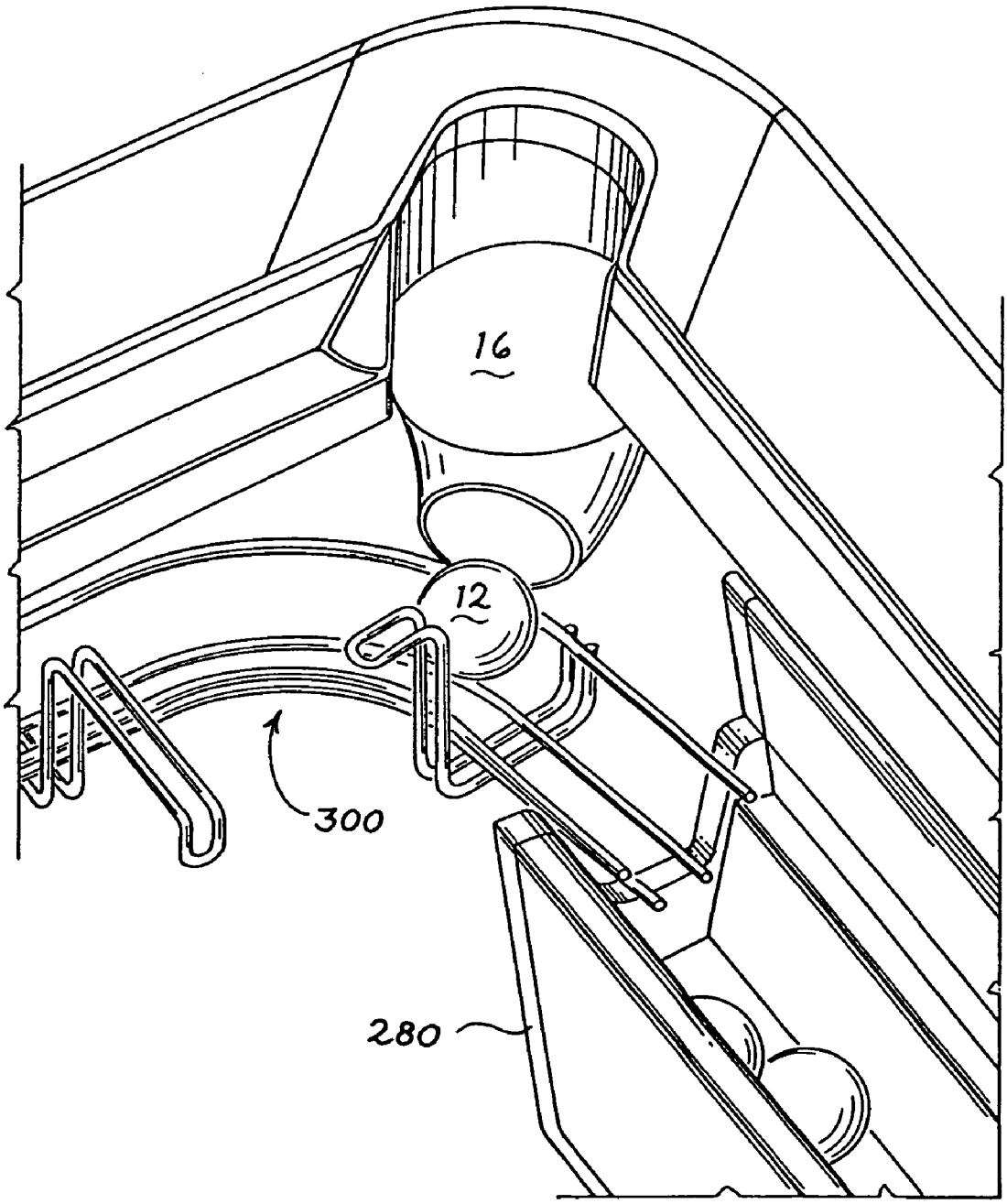
FIG. 8 is an illustration of a track communicating with a billiard ball storage compartment of an embodiment.
Figure 9:
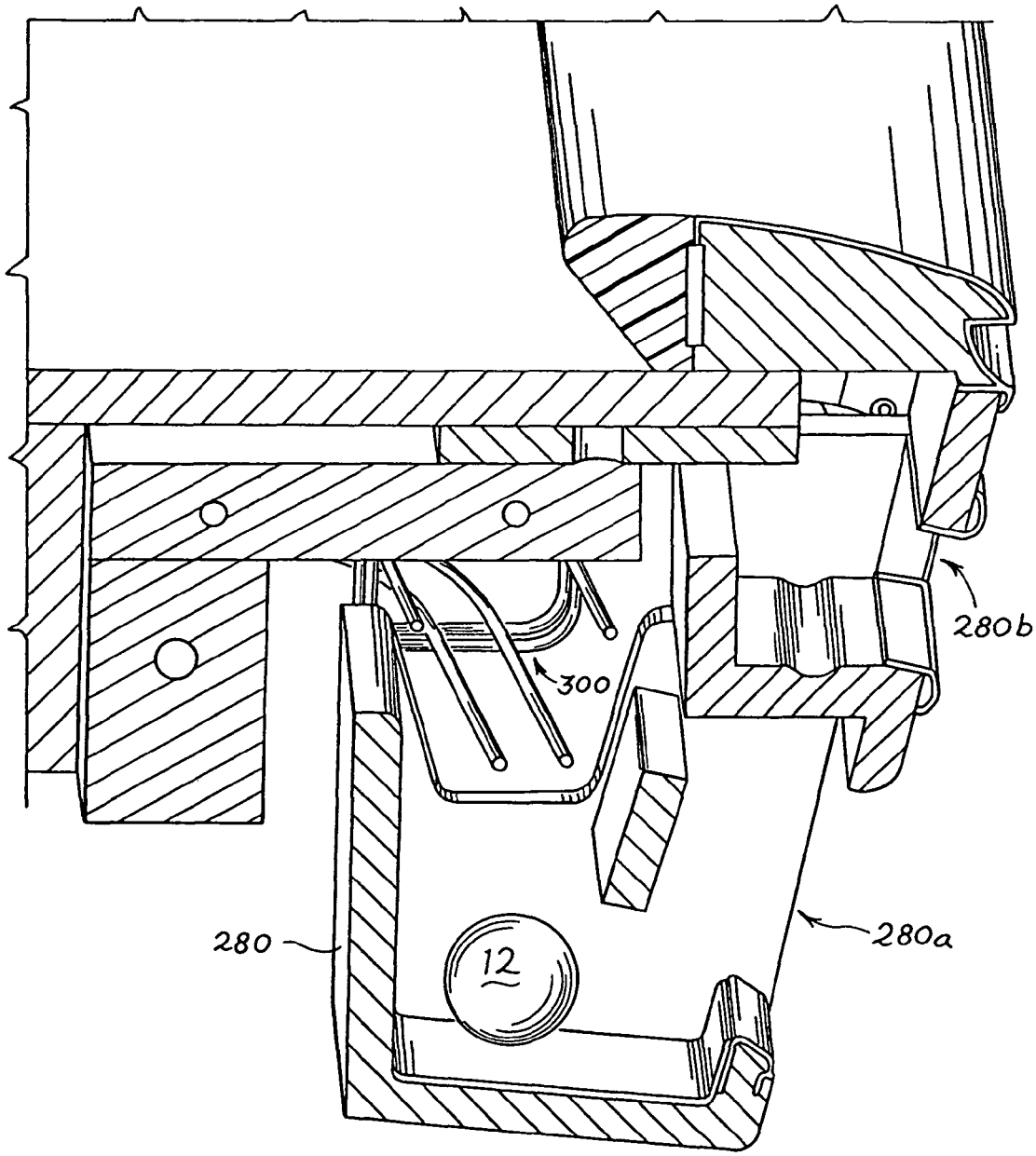
FIG. 9 is another illustration of a track communicating with a billiard ball storage compartment of an embodiment.

As mentioned above, the billiard ball storage compartment 280 contains a billiard ball receiver box 280*a*. As shown in more detail in FIGS. 8 and 9, the billiard ball receiver box 280*a* communicates with a track 300 positioned under the table. A billiard ball 12 falling into the pockets 16 of the table lands on the track 300, which facilitates the rolling of the billiard ball 12 into the billiard ball receiver box 280*a*. In this way, billiard balls 12 shot into the pockets 16 of the billiard table are conveniently gathered in one location.

In this particular embodiment, the billiard ball storage compartment 280 additionally contains a billiard ball storage box 280*b*. Unlike the billiard ball receiver box 280*a*, the billiard ball storage box 280*b* does not communicate with the track 300. Rather, the billiard ball storage box 280*b* stores billiard balls 12 (and, optionally, chalk and other accessories) that are physically placed in the box 280*b* by a user though the opening in the apron. As mentioned above, while both the billiard ball receiver box 280*a* and the billiard ball storage box 280*b* in this embodiment are secured to the table via the mating connectors (by virtue of them both being part of the billiard ball storage compartment 280), the billiard ball receiver box 280*a* and the billiard ball storage box 280*b* can be secured to the table separately (either both with mating connectors or otherwise), such as when the billiard ball storage compartment 280 contains only the billiard ball receiver box 280*a* but not the billiard ball storage box 280*b*, or vice versa.

Figure 10:
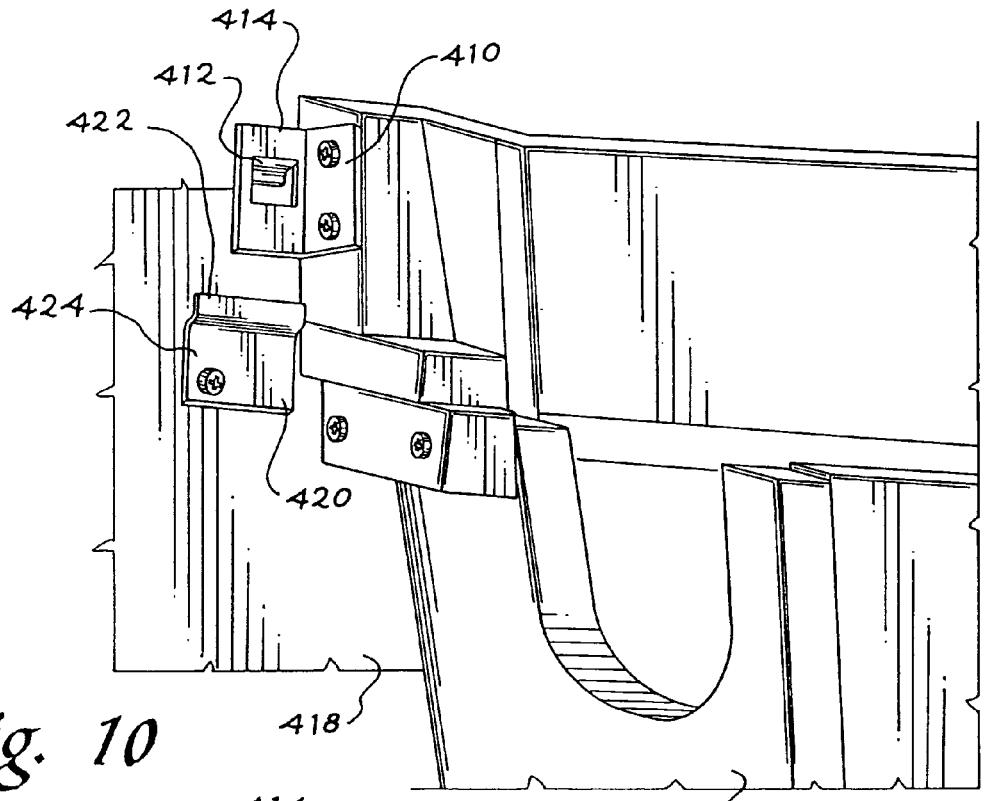
FIG. 10 is an illustration of a billiard table of an embodiment before a billiard ball storage compartment is moved into a first position.
Figure 11:
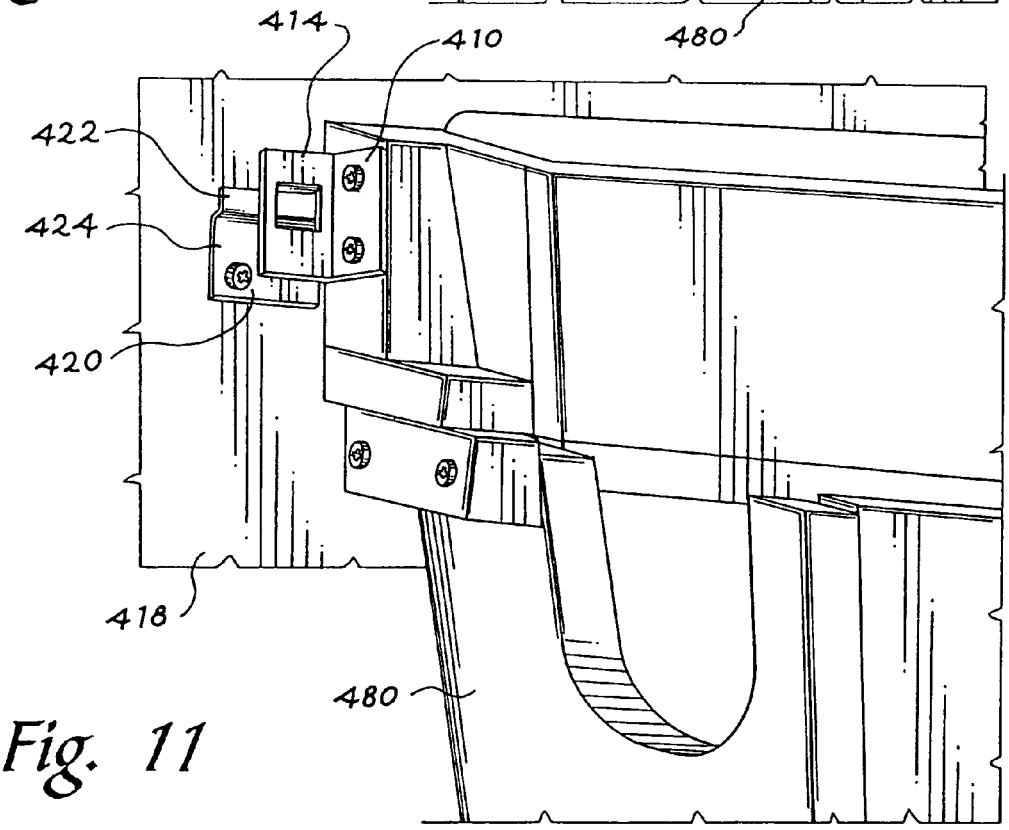
FIG. 11 is an illustration of a billiard table of an embodiment after a billiard ball storage compartment is moved into a first position.

In some of the above embodiments, the mating connectors each comprised a male portion formed as a tooth and a female portion formed as a receptacle, and the mating connectors were identically shaped but oppositely oriented from one another. As mentioned above, different types (e.g., non-identical) connectors can be used. FIGS. 10 and 11 are illustrations showing such different types of connector (of course, other types of connectors can be used). As shown in FIG. 10, a first connector 410 is attached to the billiard ball storage compartment 480 via fasteners (here, screws) through holes in the central portion 414 of the first connector 410. The first connector 410 comprises a protrusion 412 that extends from the central portion 414 at an oblique angle, such that the protrusion 412 is substantially parallel to the central portion 414 but offset by a distance from the central portion 414. In this embodiment, the protrusion 412 is formed from the central portion 414, such that the protrusion 412 leaves a hole in the central portion 414. As also shown in FIG. 10, the second mating connector 420 is attached to the frame 418 of the table via fasteners (here, screws) through holes in the central portion 424 of the second connector 420. As with the first connector 410, the second connector 420 comprises a protrusion 422 offset by a distance from the central portion 424. However, unlike the first connector 410, the protrusion 422 of the second connector 420 is the entire upper end of the second connector 420 instead of being formed from the central portion 424. An additional pair of connectors (not shown) are mounted on and near the opposite side of the billiard ball storage compartment 480. Suitable first and second connectors are available from Selby Hardware.

FIG. 10 is an illustration showing the billiard ball storage compartment 480 before it is moved into the mating ("first") position. As shown in FIG. 10, the protrusion 412 of the first connector 410 is aligned above the protrusion 422 of the second connector 420. When the billiard ball storage compartment 480 is moved into the mating ("first") position (see FIG. 11), the protrusion 412 of the first connector 410 "clips" together with the protrusion 422 of the second connector 420 (the other connectors (not shown) would similarly "clip"), thus securing the billiard ball storage compartment 480 to the table. The billiard ball storage compartment 480 can be removed from the table by lifting the billiard ball storage compartment 480 to "unclip" the first and second connectors 410, 420 (and the connectors (not shown) on the other side of the billiard ball storage compartment 480).

As should be understood from the preceding paragraphs, many alternatives can be used with these embodiments. As examples of yet additional alternatives, while the mating connectors can be directly secured to the billiard ball storage compartment and/or frame, the connectors can also be indirectly secured. For example, a component (e.g., a wooden block) can be provided between the connector and the billiard ball storage compartment and/or frame to provide an offset space for ease of assembly and removal of the connector. As another example, instead of the apron being fixed to the table with the interior of the billiard ball storage box being removably attached to the frame (as in the above embodiments), the apron (or just the bezel-framed opening) can be part of the billiard ball storage compartment. As yet another example, instead of the mating connectors being positioned on the exterior side surface(s) of the billiard ball storage compartment, some or all of the connectors can be positioned on different exterior surface(s) and/or the interior surface(s). As should be understood from these various examples, many alternatives are possible. Accordingly, the details discussed herein should not be read into the claims unless explicitly recited therein.

It is intended that the foregoing detailed description be understood as an illustration of selected forms that the invention can take and not as a definition of the invention. It is only the following claims, including all equivalents, that are intended to define the scope of this invention. Finally, it should be noted that any aspect of any of the preferred embodiments described herein can be used alone or in combination with one another.

What is claimed is:

1. A billiard table comprising:

a frame comprising a first connector;

a playing surface supported by the frame; and a billiard ball storage compartment comprising a second connector, wherein the second connector is configured to mate with the first connector when the billiard ball storage compartment is moved into a first position with respect to the frame;

wherein the billiard ball storage compartment comprises both a ball storage box and a ball receiver box;

wherein the billiard table further comprises an apron with an opening formed therein, and wherein the ball storage box is positioned adjacent to the opening when the billiard ball storage compartment is moved into the first position;

wherein the billiard table comprises a plurality of pockets and further comprises a track disposed in communication with the plurality of pockets and configured to transport billiard balls received in the plurality of pockets to the ball receiver box;

wherein the first and second connectors each comprise respective mating male and female portions; and wherein the first connector comprises a tooth configured to be received in a receptacle on the second connector, and wherein the second connector comprises a tooth configured to be received in a receptacle on the first connector.

2. The billiard table of claim 1, wherein the first and second connectors are configured to secure the billiard ball storage compartment to the billiard table without use of additional fasteners.

3. The billiard table of claim 1, wherein the first and second connectors are configured to allow the billiard ball storage compartment to be installed and removed from the billiard table without use of an external tool.

4. A billiard table comprising:

a frame comprising a first connector;

a playing surface supported by the frame;

a plurality of pockets formed in the playing surface;

a billiard ball storage compartment comprising a ball receiver box and a second connector, wherein the second connector is configured to mate with the first connector when the billiard ball storage compartment is moved into a first position with respect to the frame; and a track disposed in communication with the plurality of pockets and configured to transport billiard balls received in the plurality of pockets to the ball receiver box;

wherein the billiard ball storage compartment further comprises a ball storage box;

wherein the first and second connectors each comprise respective mating male and female portions;

wherein the first connector comprises a tooth configured to be received in a receptacle on the second connector, and wherein the second connector comprises a tooth configured to be received in a receptacle on the first connector;

wherein the billiard table further comprises an apron with an opening formed therein, and wherein the ball storage box is positioned adjacent to the opening when the billiard ball storage compartment is moved into the first position.

5. The billiard table of claim 4, wherein the first and second connectors are configured to secure the billiard ball storage compartment to the billiard table without use of additional fasteners.

6. The billiard table of claim 4, wherein the first and second connectors are configured to allow the billiard ball storage compartment to be installed and removed from the billiard table without use of an external tool.

7. A billiard table comprising:

a frame comprising a first connector;

a playing surface supported by the frame;

a plurality of pockets formed in the playing surface;

a billiard ball storage compartment comprising a ball receiver box, a ball storage box, and a second connector, wherein the second connector is configured to mate with the first connector when the billiard ball storage compartment is moved into a first position with respect to the frame; and a track disposed in communication with the plurality of pockets and configured to transport billiard balls received in the plurality of pockets to the ball receiver box;

wherein the first and second connectors each comprise a respective protrusion, and wherein the protrusions clip together when the first and second connectors are mated;

wherein the protrusion of one of the first and second connectors is formed from an entire end of said one of the first and second connectors, and wherein the protrusion of the other of the first and second connectors is formed from a central portion of said other of the first and second connectors; and wherein the billiard table further comprises an apron with an opening formed therein, and wherein the ball storage box is positioned adjacent to the opening when the billiard ball storage compartment is moved into the first position.

8. The billiard table of claim 7, wherein the first and second connectors are configured to secure the billiard ball storage compartment to the billiard table without use of additional fasteners.

9. The billiard table of claim 7, wherein the first and second connectors are configured to allow the billiard ball storage compartment to be installed and removed from the billiard table without use of an external tool.

* * * * *